US011994005B1

(12) United States Patent
Al Quaimi et al.

(10) Patent No.: US 11,994,005 B1
(45) Date of Patent: May 28, 2024

(54) ELIMINATING STICKY MATERIALS ACCUMULATION ON PRODUCTION LOGGING TOOLS

(71) Applicant: SAUDI ARABIAN OIL COMPANY, Dhahran (SA)

(72) Inventors: Bander Al Quaimi, Dhahran (SA); Hassan Al Hashim, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/069,333

(22) Filed: Dec. 21, 2022

(51) Int. Cl.
*E21B 37/06* (2006.01)
*E21B 12/00* (2006.01)
*E21B 21/08* (2006.01)

(52) U.S. Cl.
CPC ..... *E21B 37/06* (2013.01); *E21B 12/00* (2013.01); *E21B 21/08* (2013.01)

(58) Field of Classification Search
CPC ..... E21B 37/06; E21B 12/00; E21B 21/08; E21B 37/00; E21B 37/04; E21B 41/0078; E21B 49/087; B08B 3/02; B08B 3/04
See application file for complete search history.

(56) References Cited

U.S. PATENT DOCUMENTS 2,757,739 A * 8/1956 Douglas ..... E21B 36/04 166/61
3,630,078 A * 12/1971 Bonnet ..... E21B 47/10 73/152.35
4,289,576 A * 9/1981 Wilson ..... C23G 1/10 252/79.4

(Continued)

FOREIGN PATENT DOCUMENTS

CN 110513080 A * 11/2019
CN 210483708 U * 5/2020

(Continued)

OTHER PUBLICATIONS

Francesco Anglani, John Barry, and Willem Dekkers , "A numerical study on high-pressure water-spray cleaning for CSP reflectors", AIP Conference Proceedings 1734, 160001 (2016) https://doi.org/10.1063/1.4949242.

(Continued)

*Primary Examiner* — Daniel P Stephenson
(74) *Attorney, Agent, or Firm* — Vorys, Sater, Seymour and Pease, LLP

(57) ABSTRACT

A wellbore system includes a logging tool operable for taking measurements in a wellbore and a spinner flow meter carried by the logging tool. The spinner flow meter is operable for determining a local speed of a fluid impinging upon an impeller of the spinner flow meter. The wellbore system also further includes a fluid source including a solvent for inhibiting the adherence of a sludge on the logging tool. A pump is in fluid communication with the fluid source and is operable to impart a hydraulic pressure to the solvent. At least one hydraulic nozzle is carried by the logging tool, and the at least one hydraulic nozzle is directed at the impeller of the spinner flow meter and is in fluid communication with the pump. A controller is operably coupled to the pump to selectively deliver the solvent to the at least one hydraulic nozzle.

16 Claims, 3 Drawing Sheets

(56) References Cited

U.S. PATENT DOCUMENTS

| | | | | |
|---|---|---|---|---|
| 4,827,765 | A * | 5/1989 | Kessler | G01F 1/10 73/152.35 |
| 2011/0139442 | A1* | 6/2011 | Ziauddin | E21B 49/08 166/250.01 |
| 2012/0166157 | A1* | 6/2012 | Whittaker | G01N 25/60 703/2 |
| 2013/0081459 | A1* | 4/2013 | Memiche | E21B 4/18 73/152.29 |
| 2017/0051607 | A1* | 2/2017 | Whittaker | E21B 43/24 |
| 2017/0138772 | A1* | 5/2017 | Neilson | G01F 1/053 |
| 2023/0392494 | A1* | 12/2023 | Al-Huwaider | E21B 49/0875 |

FOREIGN PATENT DOCUMENTS

| | | | | |
|---|---|---|---|---|
| CN | 115127625 | A * | 9/2022 | |
| WO | WO-2013141956 | A1 * | 9/2013 | E21B 47/10 |

OTHER PUBLICATIONS

Hassen, Nasir & Sidik, Nor. (2021). Nozzle Type and Driving Speed Effects on Spray Density of Aerial Application According to the Wind Tunnel Measurements. Journal of Advanced Research in Fluid Mechanics and Thermal Sciences. 84. 101-110. 10.37934/arfmts.84.1.101110.

Seki, Hiroto & Ikari, Satoshi & Funase, Ryu & Nakasuka, Shinichi. (2020). A Study on Debris Removal System Using Laser Pressure from Ground Stations. Transactions of the Japan Society for Aeronautical and Space Sciences, Aerospace Technology Japan. 18. 299-308. 10.2322/tastj.18.299.

* cited by examiner

ELIMINATING STICKY MATERIALS ACCUMULATION ON PRODUCTION LOGGING TOOLS

FIELD OF THE DISCLOSURE

The present disclosure relates generally to data acquisition in wellbores and, more particularly, to systems and methods for sustaining the operation of equipment deployed in hydrocarbon wellbores for assessing production parameters.

BACKGROUND OF THE DISCLOSURE

In oilfield production operations, valuable hydrocarbons are drawn from subterranean locations to surface facilities through a wellbore. The performance and health of a producing wellbore may be assessed by monitoring the dynamics and nature of the fluids flowing into the wellbore from the subterranean locations. Downhole tools are deployed into the wellbore to take in-situ measurements during the production operations. For example, flowmeters (e.g., spinners), local probes, nuclear logging tools, phase-velocity logging tools, production logging sensors, etc., may be employed to measure various downhole parameters, such as temperature, flow rate, density, phase velocity, phase holdup, global pipe quantity, mixture density, mixture velocity, water holdup, water velocity, gas holdup, pipe averaged measurement, and other characteristics.

Some of the downhole measurements may be impaired by organic or inorganic sludge such as asphaltene, maltenes, emulsions or other viscous fluids or substances in the wellbore. For example, instruments employed to take the downhole measurements may be susceptible to damage or improper operation due to the interaction with these fluids, which may be sticky or highly viscous in nature. Spinners, which are often deployed to determine the velocity of fluid flowing around them, may often encounter undue resistance from these sticky fluids or substances. The spinners may thus provide readings that are lower in magnitude that the true velocity, and in some instances may stop spinning altogether and provide no data to an operator.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a wellbore system is disclosed and includes a logging tool operable for taking measurements in a wellbore, a spinner flow meter carried by the logging tool and operable for determining a local speed of a fluid impinging upon an impeller of the spinner flow meter, and at least one hydraulic nozzle carried by the logging tool and directed at the impeller of the spinner flow meter for discharging a solvent for inhibiting the adherence of a sludge on the logging tool.

According to another embodiment consistent with the present disclosure, a method of conducting a logging operation in a wellbore is disclosed and includes the steps of conveying a logging tool into the wellbore, the logging tool operable for taking measurements in the wellbore, determining a local speed of a wellbore fluid impinging upon an impeller of a spinner flow meter carried by the logging tool, pumping a solvent to the logging tool in the wellbore, expelling the solvent through at least one hydraulic nozzle carried by the logging tool and directed at the impeller, and interacting the solvent with the logging tool and the wellbore fluid to thereby inhibit adherence of a sludge on the logging tool.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
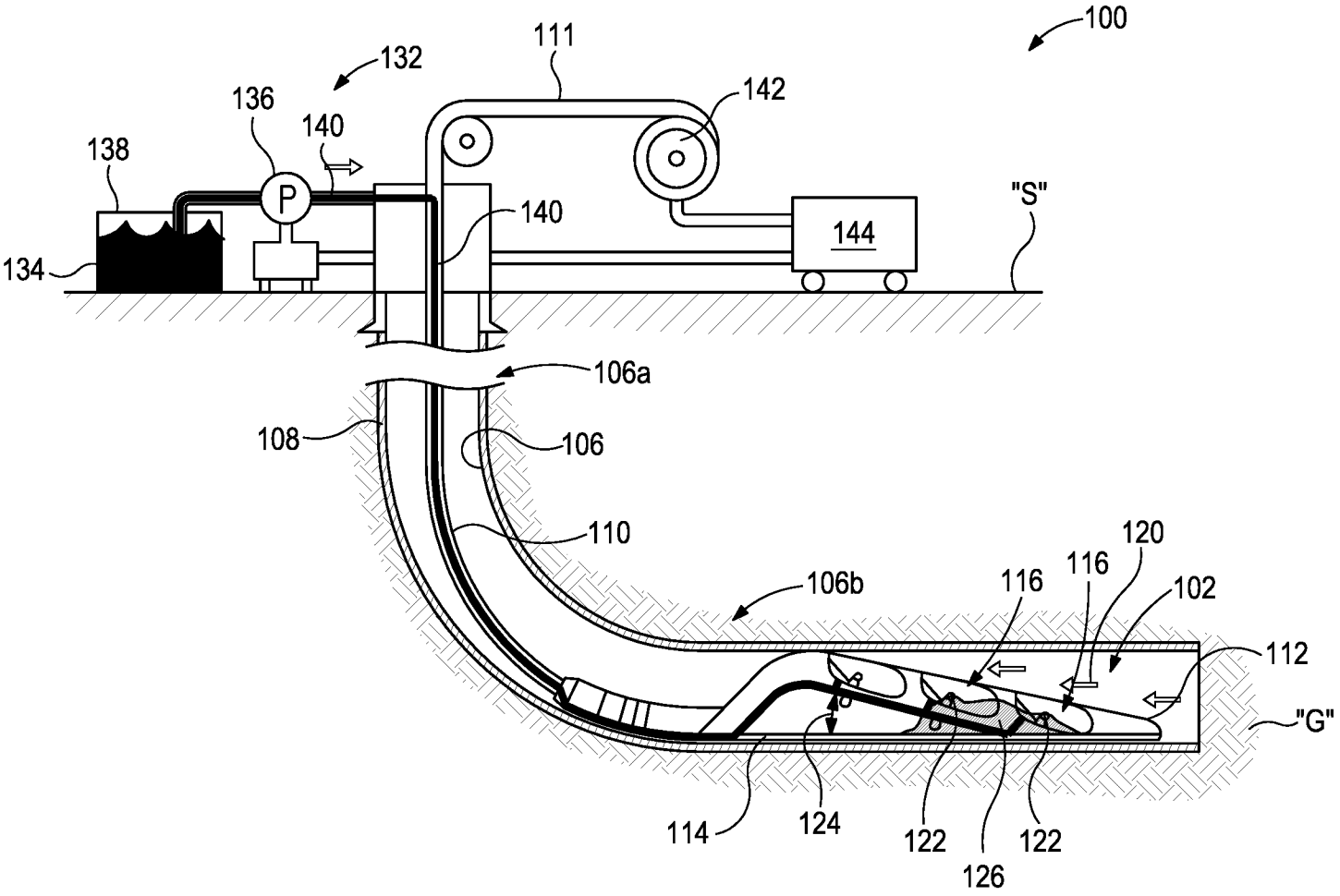
FIG. 1 is a partial cross-sectional side view of a wellbore system including an example logging tool constructed in accordance with one or more exemplary embodiments of the disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to systems and methods to perform downhole measurements. In certain embodiments, a downhole tool includes a plurality of rotatable spinners arranged to assess the local velocity and proportions of various phases of fluid flowing in a wellbore. Hydraulic nozzles are positioned adjacent the spinners to deliver a solvent downhole that will prevent the spinners from becoming unduly obstructed by organic or inorganic sludge in the wellbore.

FIG. 1 is a schematic view of a wellbore system 100 that includes a logging tool 102 in accordance with example embodiments of the present disclosure. The logging tool 102 is disposed in a wellbore 106 extending from a surface location "S" and traversing a geologic formation "G." In the illustrated example, the wellbore 106 is shown generally including a vertical portion 106*a* extending from the surface location "S" and a horizontal portion 106*b* extending from the vertical portion 106*a*. It will be understood that the wellbore 106 may include any of a wide variety of vertical, directional, deviated, slanted and/or horizontal portions therein, and may extend along any trajectory through the geologic formation "G." As illustrated in FIG. 1, the wellbore 106 is lined with a casing string 108, however, in other embodiments, the wellbore 106 may not be cased.

The logging tool 102 is illustrated as having been conveyed into the horizontal portion 106*b* of the wellbore 106 on a work string 110. The work string 110 may include any type of conveyance 111 such as a coiled tubing strand, pipe string, electric wireline, etc. with the logging tool 102 coupled to a lower end thereof. The work string 110 may include conductors (not shown) for supplying electrical energy (power) to downhole devices and communication links for providing two-way communication between the logging tool 102 and the equipment disposed at the surface location "S." The conductors may be components of an armored cable, wired drill pipe or another form recognized in the art.

The logging tool 102 may include a support arm 112 extending from a longitudinal base or housing 114. In some embodiments, the support arm 112 may be aligned with the longitudinal housing 114 to facilitate deployment of the logging tool 102 into the wellbore 106 and once at the desired depth in the wellbore 106, the support arm 112 may be selectively extended from the longitudinal housing 114 to position one or more spinner flow meters 116 in a flow of wellbore fluid 120. The wellbore fluid 120 may include hydrocarbons and the like moving in an uphole direction toward the surface location "S," for example, in a production operation as illustrated in FIG. 1. In other embodiments, the wellbore fluid 120 may be moving in an opposite downhole direction, for example, in an injection operation.

Each spinner flow meter 116 includes an impeller 122 and is configured to measure a velocity of the wellbore fluid 120. More specifically, the velocity of the wellbore fluid 120 may be determined based on a rotational speed of the impeller 122 induced by the wellbore fluid 120 impinging on the impellers 122 as the wellbore fluid 120 flows past the spinner flow meters 116. In other embodiments, the impellers 122 may exhibit a helical or vane shape, or any other shape capable of being forced into rotation as impinged upon by a flowing fluid, without departing from the scope of the disclosure.

In addition to the spinner flow meters 116, the logging tool 102 may also include any number of various tools, sensors, measurement devices, communication devices, and the like, which will not all be described in detail in the interest of clarity.

The support arm 112 may be extended to an angle 124 with respect to the horizontal portion 106*b* of the wellbore 106 to position each spinner flow meter 116 at a different vertical level within the wellbore 106. In the horizontal portion 106*b*, the fluid phases of wellbore fluid 120 segregate horizontally due to gravity and density. The logging tool 102 may thus measure fluid velocities at multiple vertical levels in which a given spinner flow meter 116 is disposed. Although the logging tool 102 is illustrated within the horizontal portion 106*b*, it should be appreciated that the logging tool 102 may also be operable in inclined or substantially vertical portions of the wellbore 106 as well.

An accumulation of sludge 126 is illustrated on the logging tool 102. If not controlled or restrained, the sludge 126 may include asphaltenes, maltenes, emulsions or other organic or inorganic oily or sticky fluids which may interfere with the rotation of the impellers 122. To address the accumulation of sludge 126, the wellbore system 100 may include a fluid pumping system 132 at the surface location "S" that is operable to deliver a solvent 134 to the logging tool 102. The solvent 134 may include fluids such as diesel, hexane, toluene or ethers, such as methyl-tert-butyl-ether, and may be selected based upon the type and amount of sludge 126 expected. In various embodiments, the solvent 134 may include surfactants or other cleaning solutions as a component thereof, or the solvent may 134 may be entirely composed of a surfactant or other cleaning solution selected to address the expected sludge 126.

The pumping system 132 includes a pump 136 to provide a fluid pressure to the solvent 134, which may be employed to drive the solvent 134 from a fluid source 138 into the wellbore 106. The solvent 134 may be delivered downhole via a supply line or conduit 140 arranged internally or on an exterior surface of the conveyance 111. The pumping system 132 may deliver the solvent 134 to each of the spinner flow meters 116 collectively, individually or to any subset of the spinner flow meters 116 as desired.

Although the pump 136 and fluid source 138 are illustrated at the surface location "S" in FIG. 1, principles of the disclosure may be implemented with a downhole pumping system (not shown) as well. More specifically, the volume or amount of the solvent 134 required to properly clean the logging tool 102 may be minimal. In such embodiments, the fluid pumping system 132, including the pump 136 and the fluid source 138, may be arranged downhole at or near the logging tool 102 and otherwise forming part of the logging tool 102. In such embodiments, the fluid source 138 may comprise a cylinder (container) attached to the logging tool 102 and containing an amount of the solvent 134. The pump 136 may be in fluid communication with the cylinder and operable to pump the solvent 134 from the cylinder as needed to mitigate accumulation of the sludge 126. In some embodiments, the pump 136 may be controlled from the surface, but could alternatively be controlled autonomously downhole using sensors, a timing device, or a combination thereof.

To control the rate of travel of the conveyance 111 and conduit 140 in the wellbore 106, tension on the conveyance 111 is controlled with a winch 142. A controller 144 is operably coupled to the pump 136, the winch 142 and to the logging tool 102 to provide instructions to, and receive data from, the logging tool 102. In some embodiments, the controller 144 may be a computer-based system that may include a processor, a memory storage device, and programs and instructions, accessible to the processor for executing the instructions utilizing the data stored in the memory storage device. In other embodiments, the controller may include manual controls that may be manipulated by an operator to control any of the procedures and equipment described herein.

Figure 2:
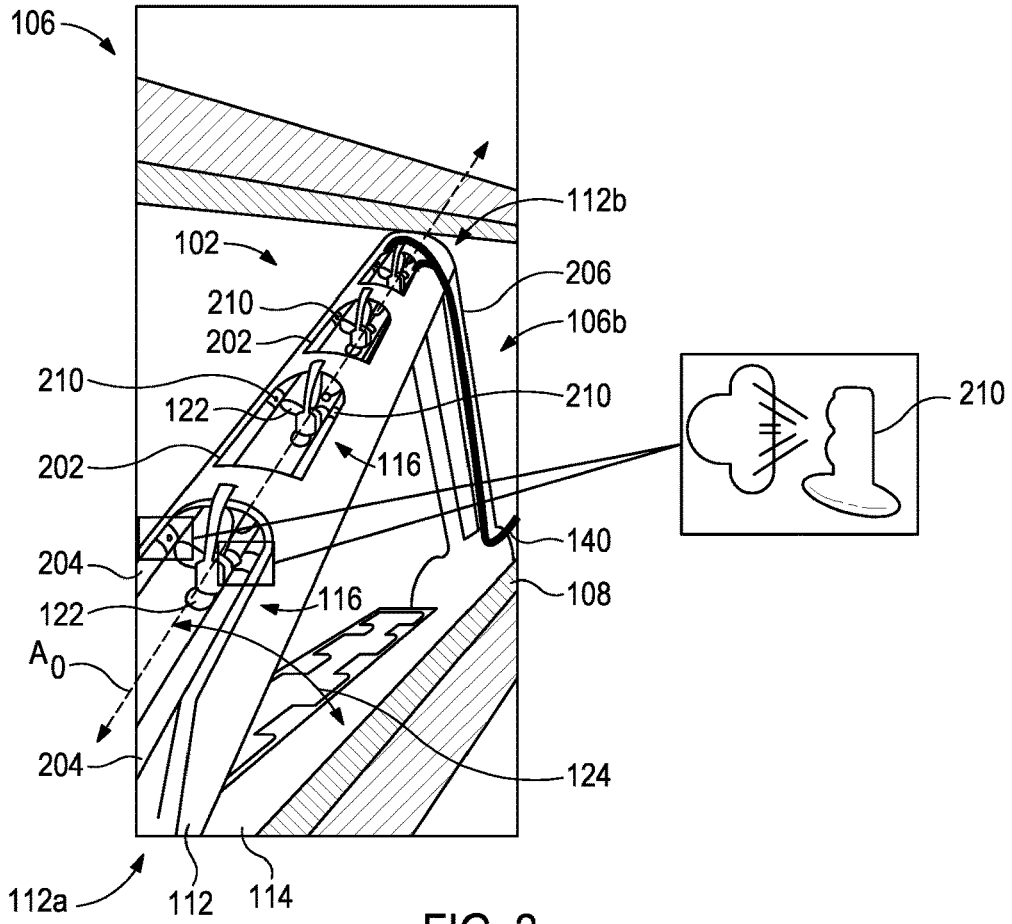
FIG. 2 is an enlarged perspective view of the logging tool of FIG. 1 illustrating an array of spinner flow meters with hydraulic nozzles positioned adjacent the spinner flow meters.

Referring to FIG. 2, an enlarged perspective view of the logging tool 102 is illustrated, according to one or more embodiments. As illustrated, the longitudinal housing 114 of the logging tool 102 rests on the casing string 108 at a lowermost point of a cross-section of the casing string 108, where a lower or leading end 112*a* of the support arm 112 is coupled to the longitudinal housing 114. The support arm 112 extends to an upper or trailing end 112*b* at the uppermost point of the cross-section of the casing string 108. The support arm 112 generally extends along an axis $A_O$ at angle 124 with respect to the longitudinal housing 114, thus extending the longitudinal housing across each vertical level of the horizontal portion 106*b* of the wellbore 106.

The support arm 112 is constructed as a generally hollow tubular member including a plurality of forward openings 202 formed therein. Each of the spinner flow meters 116 is longitudinally (axially) spaced from one another along the support arm 112 and supported in a corresponding forward opening 202 such that wellbore fluid 120 (FIG. 1) flowing through the support arm 112 impinges on the impellers 122. Each of the spinner flow meters 116 is supported at a different vertical level within the wellbore 106 and with respect to the longitudinal housing 114 such that the local speed, velocity or flow rate of various vertically-separated fluid components of the wellbore fluid 120 (FIG. 1) may be measured by the spinner flow meters 116.

A pair of solvent delivery tubes 204 may be supported within the support arm 112 adjacent the spinner flow meters 116 and may be configured to circulate the solvent 134 (FIG. 1). Each solvent delivery tube 204 extends axially (longitudinally) on opposing lateral sides of the spinner flow meters 116 and is fluidly coupled to the conduit 140 such that solvent 134 may be selectively delivered to the solvent delivery tubes 204. As illustrated, the conduit 140 may extend through upright supports 206 of the logging tool 102 that extend between the longitudinal housing 114 and the trailing end 112*b* of the support arm 112.

With reference to the inset graphic in FIG. 2, spray nozzles 210 are axially spaced along the solvent delivery tubes adjacent each of the spinner flow meters 116. The spray nozzles 210 are directed at the impellers 122 such that the solvent 134 (FIG. 1) may be delivered to each individual impeller 122 through one or more (e.g., a pair) of spray nozzles 210. As the spinner flow meters 116 are in operation acquiring data to generate wellbore logs, the spray nozzles 210 may deliver solvent 134 (FIG. 1) to the impellers intermittently, continuously and/or in accordance with a predetermined schedule.

Figure 3:
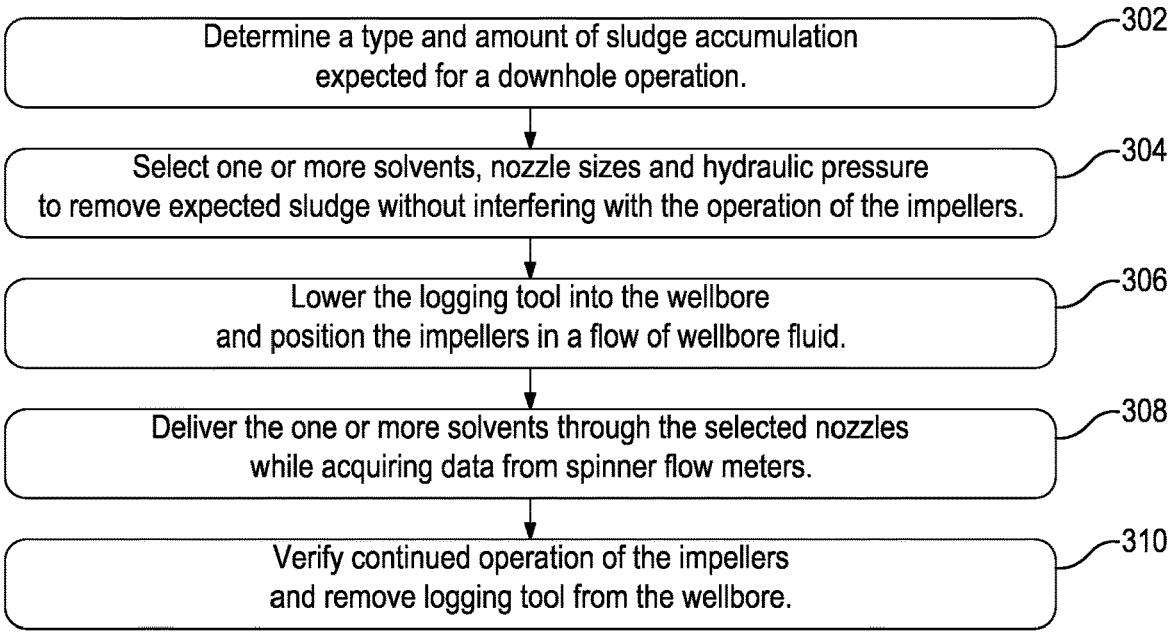
FIG. 3 is a flowchart illustrating a procedure for operating the logging tool of FIG. 1 in accordance with example embodiments of the disclosure.

Referring to FIG. 3, and with continued reference to FIGS. 1 and 2, a procedure 300 for a downhole logging operation employing the logging tool 102 is schematically depicted. Initially at step 302, a type of sludge 126 expected to be encountered in the wellbore 106 and the amount of sludge 126 expected is determined. Estimates may be based on fluid samples retrieved from the wellbore, previous logging operations and/or data available from nearby or similar wellbores. Once the type and amount of expected sludge 126 is determined, the procedure proceeds to step 304 where various operational parameters are selected to address the accumulation of the expected sludge 126 on the logging tool 102. For example, one or more solvents may be selected to interact with the expected sludge 126 and thereby hinder the adherence of the sludge 126 to the logging tool 102 or other downhole equipment. In addition to selecting the type of solvent 134, the size of the spray nozzles 210, and the hydraulic pressure and schedule for delivering the solvent 134 may be selected. Computer modeling, historical logs and/or empirical analysis may be employed to determine the size of spray nozzles 210 and hydraulic pressure that will hinder the accumulation of sludge 126 without interfering with the operation of the impellers 122. The selected spray nozzles may be installed on the solvent delivery tubes 204 to prepare the logging tool 102 for deployment into the wellbore 106.

Next at step 306, the logging tool 102 may be conveyed into the wellbore 106 on the conveyance 110. Once the logging tool 102 has reached the proper depth, the support arm 112 may be extended from the longitudinal housing 114 by the application of hydraulic or mechanical force as recognized in the art. The extension of the support arm 112 positions the spinner flow meters 116 in the flow of wellbore fluid 120. The wellbore fluid 120 may impinge on the impellers 122, and cause the impellers 122 to rotate.

At step 308, data regarding the velocity of the wellbore fluid 120 at the various vertical levels where the spinner flow meters 116 may be acquired and logged. While the impellers 122 are operating, the one or more solvents 134 may be pumped downhole with pump 136. The controller 144 may be employed to operate the pump 136 to deliver the solvent to the impellers 122 at the schedule and pressures determined in step 304. For instance, a relatively low pressure may be employed to intermittently deliver the solvent 134 to the impellers 122. A relatively high pressure may be employed at any planned interruptions in data collection, for example, to more thoroughly remove the sludge 126. The hydraulic pressure and schedules may be adjusted during the logging operation if any data collected suggests that an adjustment may be beneficial. For example, if an impeller 122 slows unexpectedly, the frequency of solvent delivery can be increased to ensure the sludge 126 is being effectively cleaned. Similarly, if a surge in the velocity of the wellbore fluid is detected each time the solvent 134 is delivered to the impellers 122, the hydraulic pressure provided by the pump 136 can be reduced such that the solvent does not interfere with the data collected from the rotating impellers. The wellbore system 100 provides the ability for adjustments to the made while the logging tool 102 is deployed and operational. An expensive and time consuming extraction of the logging tool 102 from the wellbore 106 to allow for cleaning of the logging tool 102 and wellbore 106 may be avoided.

At step 310, any data logs generated may be evaluated to verify that the impellers 122 continued to operate for the entire logging operation as intended. The logging tool 102 may then be removed from the wellbore 106.

Figure 4:
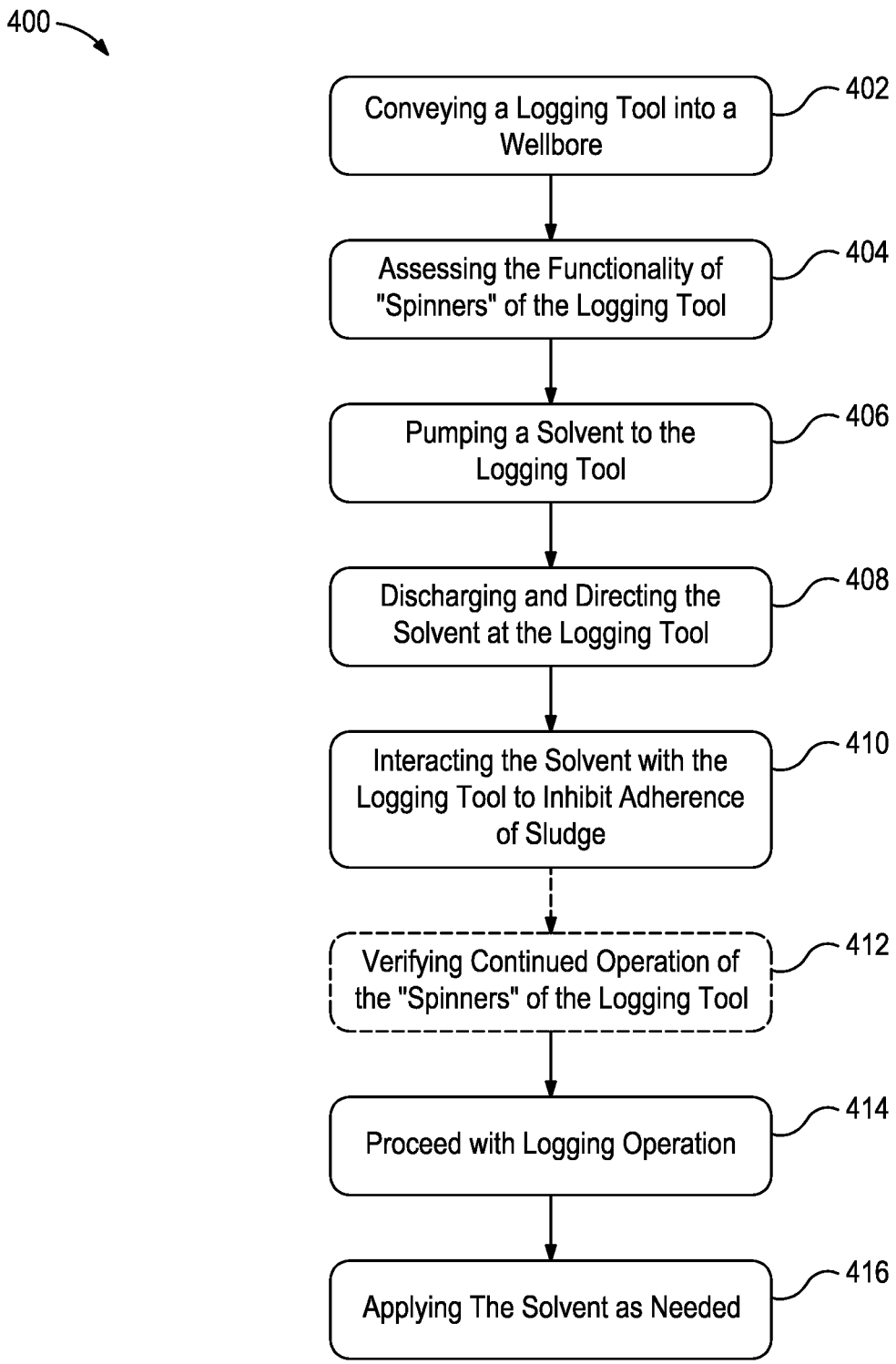
FIG. 4 is a schematic of an example method of conducting a logging operation, according to one or more embodiments of the disclosure.

FIG. 4 is a schematic of an example method 400 of conducting a logging operation, according to one or more embodiments of the disclosure. The method 400 may be best understood with reference to FIGS. 1 and 2 and, in particular, the operational description of the logging tool 102. As illustrated, the method 400 may include conveying the logging tool 102 into a wellbore, as at 402, where the logging tool 102 is operable for taking fluid flow measurements in the wellbore. While located downhole, the logging tool 102 may then be operated to assess the functionality of the impellers 122 or "spinners" included in the logging tool 102, as at 404. This assessment of the logging tool 102 may determine if the impellers 122 are properly operating or malfunctioning. At least one because of a malfunction may be the buildup of sludge 126 on the logging tool 102, and more particularly, the impellers 122. Assessing the condition of the logging tool 102 may also include determining a local speed of a wellbore fluid impinging upon one or more of the impellers 122.

The method 400 may further include pumping a solvent to the logging tool 102, as at 406. In some embodiments, the solvent may be pumped from the well surface into the wellbore and ultimately to the logging tool 102, but could alternatively be pumped from a localized position at or near the logging tool 102 within the wellbore. The solvent may then be discharged and directed at the logging tool 102, and more particularly the impellers 122, as at 408. In one or more embodiments, the solvent is discharged via at least one hydraulic nozzle carried by the logging tool and directed at the impellers 122. In such embodiments, the type and quantity of solvent discharged or applied may be based on a prior knowledge of the size of the hydraulic nozzle. The solvent may be configured to interact with the logging tool 102 and, more particularly, the impellers 122 to thereby inhibit adherence of a sludge on the logging tool 102, as at 410. Optionally, continued operation of the impellers 122 or "spinners" may then be verified, as at 412, and the logging tool 102 may then proceed with a logging operation, as at 414. The solvent may subsequently be applied as needed to ensure proper operation of the logging tool, as at 416.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A wellbore system, comprising:

a logging tool operable for taking measurements in a wellbore;

a spinner flow meter carried by the logging tool and operable for determining a local speed of a fluid impinging upon an impeller of the spinner flow meter;

at least one hydraulic nozzle carried by the logging tool and directed at the impeller of the spinner flow meter for discharging a solvent for inhibiting the adherence of a sludge on the logging tool;

a support arm on which the spinner flow meter is supported, the support arm defining a longitudinal axis; and at least one solvent delivery tube supported by the support arm and extending longitudinally along the support arm to a lateral side of the impeller, wherein the at least one hydraulic nozzle is arranged in the at least one solvent delivery tube.

2. The wellbore system of claim 1, wherein the at least one hydraulic nozzle includes a pair of hydraulic nozzles supported on opposite lateral sides of the impeller.

3. The wellbore system of claim 2, wherein the at least one solvent delivery tube includes:

a pair solvent delivery tubes supported by the support arm and disposed on the opposite lateral sides of the impeller, wherein the pair of hydraulic nozzles are arranged in the pair of solvent delivery tubes.

4. The wellbore system of claim 1, wherein the spinner flow meter is a first spinner flow meter and the wellbore system further comprises a second spinner flow meter longitudinally spaced from the first spinner flow meter and supported by the support arm, and wherein the at least one solvent delivery tube extends longitudinally between the first and second spinner flow meters.

5. The wellbore system of claim 4, wherein the logging tool further comprises a longitudinal housing, and wherein the support arm extends at an angle from the longitudinal housing such that the first and second spinner flow meters are supported at different vertical levels with respect to the longitudinal housing.

6. A wellbore system, comprising:

a logging tool operable for taking measurements in a wellbore;

a spinner flow meter carried by the logging tool and operable for determining a local speed of a fluid impinging upon an impeller of the spinner flow meter;

at least one hydraulic nozzle carried by the logging tool and directed at the impeller of the spinner flow meter for discharging a solvent for inhibiting the adherence of a sludge on the logging tool;

a fluid source including a solvent for inhibiting the adherence of a sludge on the logging tool;

a pump in fluid communication with the fluid source and operable to impart a hydraulic pressure to the solvent; and a controller operably coupled to the pump to selectively deliver the solvent to the at least one hydraulic nozzle.

7. The wellbore system of claim 6, further comprising a conveyance coupled to the logging tool and a conduit extending along the conveyance, wherein the conduit is fluidly coupled between the pump and the at least one hydraulic nozzle.

8. The wellbore system of claim 6, wherein the solvent is selected from the group consisting of diesel, hexane, toluene, and an ether.

9. A method of conducting a logging operation in a wellbore, the method comprising:

conveying a logging tool into the wellbore, the logging tool operable for taking measurements in the wellbore;

determining a local speed of a wellbore fluid impinging upon an impeller of a spinner flow meter carried by the logging tool;

pumping a solvent to the logging tool in the wellbore;

expelling the solvent through at least one hydraulic nozzle carried by the logging tool and directed at the impeller; and interacting the solvent with the logging tool and the wellbore fluid to thereby inhibit adherence of a sludge on the logging tool.

10. The method of claim 9, further comprising determining a type of sludge expected to accumulate during the logging operation and selecting the solvent based on the type of sludge expected.

11. The method of claim 10, wherein selecting the solvent includes selecting at least one of the group consisting of diesel, hexane, toluene, and ether.

12. The method of claim 9, wherein expelling the solvent is performed intermittently or continuously during the logging operation while the logging tool is disposed in the wellbore.

13. The method of claim 12, further comprising adjusting either a hydraulic pressure applied to the solvent with the pump or a schedule at which the solvent is expelled based on the determined local speed of the wellbore fluid.

14. The method of claim 9, further comprising supporting the spinner flow meter on a support arm of the logging tool at a first vertical position in the wellbore and supporting at least one additional spinner flow meter on the support arm at a second vertical position in the wellbore.

15. The method of claim 14, wherein positioning the spinner flow meter and the at least one additional flow meter in the wellbore includes positioning the logging tool in a substantially horizontal portion of the wellbore.

16. The method of claim 9, wherein expelling the solvent through at least one hydraulic nozzle includes expelling the solvent through a pair of hydraulic nozzles disposed on opposite lateral sides of the impeller.

* * * * *